US010753078B2

(12) United States Patent
Fedorov et al.

(10) Patent No.: US 10,753,078 B2
(45) Date of Patent: Aug. 25, 2020

(54) MULTI-PURPOSE BUILDING

(71) Applicant: OBSCHESTVO S OGRANICHENNOI OTVETSTVENNOSTYU "TEPLORIUM", Cheboksary (RU)

(72) Inventors: Anatoly Nikolaevich Fedorov, Novocheboksarsk (RU); Liudmila Anatolievna Maksimova, Cheboksary (RU)

(73) Assignee: OBSHHESTVO S OGRANICHENNOJ OTVETSTVENNOST'JU "TEPLORIUM", Cheboksary (RU)

( * ) Notice: Subject to any disclaimer, the term of this patent is extended or adjusted under 35 U.S.C. 154(b) by 0 days.

(21) Appl. No.: 16/309,457

(22) PCT Filed: Aug. 24, 2016

(86) PCT No.: PCT/RU2016/000570
§ 371 (c)(1),
(2) Date: Dec. 13, 2018

(87) PCT Pub. No.: WO2018/034587
PCT Pub. Date: Feb. 22, 2018

(65) Prior Publication Data

US 2019/0309507 A1 Oct. 10, 2019

(30) Foreign Application Priority Data

Aug. 19, 2016 (RU) ..... 2016134024

(51) Int. Cl.
*E04B 7/08* (2006.01)
*E04B 1/32* (2006.01)
(Continued)

(52) U.S. Cl.
CPC ..... *E04B 1/3211* (2013.01); *E04B 1/32* (2013.01); *E04B 7/08* (2013.01); *E04H 15/18* (2013.01);
(Continued)

(58) Field of Classification Search
CPC ..... E04B 7/08; E04B 1/32; E04B 1/19; E04B 2001/1927; E04B 2001/1933;
(Continued)

(56) References Cited

U.S. PATENT DOCUMENTS 2,499,478 A * 3/1950 Feser ..... E04B 1/32 52/81.3
3,888,056 A * 6/1975 Kelly ..... E04B 1/32 52/109
(Continued)

FOREIGN PATENT DOCUMENTS

RU 2280130 C2 7/2006
RU 2298618 C2 5/2007
RU 110392 U 7/2011

*Primary Examiner* — Chi Q Nguyen
(74) *Attorney, Agent, or Firm* — Dmitry S. Kryndushkin, IP Center Skolkovo

(57) ABSTRACT

A dome- or sphere-shaped multipurpose building is disclosed, which is a prefabricated quickly erected structure and can be used for erecting the buildings of various functional purpose, of different number of floors, both heated and unheated, including residential buildings, cottages, industrial, administrative, sport, temporary portable buildings, arch structure. Technical result of the claimed invention is to reduce the material consumption, installation time, increase the strength and stability of the building, including under conditions of asymmetrical and dynamic loads, and to increase energy efficiency and translucence of the building. The multipurpose dome-shaped building comprises a bearing frame made in the form of at least three pyramidal volumetric trusses arranged symmetrically with
(Continued)

respect to the base center and rigidly connected to each other in the upper part by at least one horizontal beam, and wherein the volumetric trusses are arranged in such a way that the horizontal distance between closest posts of neighboring volumetric trusses remains the same over the entire height from the base and up to the top of the neighboring trusses.

15 Claims, 8 Drawing Sheets

(51) Int. Cl.
*E04H 15/18* (2006.01)
*E04H 15/36* (2006.01)

(52) U.S. Cl.
CPC ..... *E04H 15/36* (2013.01); *E04B 2001/3288* (2013.01); *E04B 2001/3294* (2013.01)

(58) Field of Classification Search
CPC ..... E04B 1/1909; E04B 1/1912; E04B 7/105; E04B 7/10; E04B 1/1924; E04C 3/02; E04C 2003/0404
USPC ..... 52/81.1, 80.1, 80.2, 81.2, 81.6, 646, 52/651.11
See application file for complete search history.

(56) References Cited

U.S. PATENT DOCUMENTS 5,067,288 A * 11/1991 Takahama ..... E04B 1/3211 52/81.2
5,146,719 A * 9/1992 Saito ..... E04B 1/3211 52/80.1
5,444,946 A * 8/1995 Zeigler ..... E04H 15/50 52/86
6,141,934 A * 11/2000 Zeigler ..... E04H 15/50 135/121
6,722,091 B1 * 4/2004 Leslie ..... E04G 21/10 428/106
7,152,384 B1 * 12/2006 McCarty ..... E04B 1/3211 52/639
7,533,498 B2 * 5/2009 Zeigler ..... E04B 1/3205 135/128
7,533,681 B2 * 5/2009 Miller ..... E04B 1/3211 135/120.3
8,082,938 B2 * 12/2011 Prusmack ..... E04B 1/32 135/122
2001/0023561 A1 * 9/2001 Henbid ..... E04H 15/18 52/222
2008/0307718 A1 * 12/2008 Ellen ..... E04B 7/105 52/80.1

* cited by examiner

MULTI-PURPOSE BUILDING

CROSS-REFERENCE TO RELATED APPLICATION

This application is a National stage of International Application No. PCT/RU2016/000570 filed on Aug. 24, 2016, which claims benefit of priority to Russian Application No. 2016134024 filed on Aug. 19, 2016, both of which are incorporated by reference herein.

FIELD OF THE INVENTION

The invention relates to a dome- or sphere-shaped multipurpose building, which is a prefabricated quickly erected structure and can be used for erecting the buildings of various functional purpose, of different number of storeys, both warm and cold, including residential buildings, cottages, industrial, administrative, sport, agricultural, warehouse, temporary portable buildings, arch structures, atrium roof, atrium room, located above the top floor of a building.

BACKGROUND OF THE INVENTION

There is a known dome-shaped structure, disclosed in SU 1694809 A1, publ. on 30 Nov. 1991. The known dome-shaped structure comprises a cancellated frame formed by arched elements converging at the dome apex, configured to can be rotated about the vertical axis, and by quadrangles pivotally connected with each other, one side of each of which is aligned with the corresponding arch and the cover. Wherein the dome frame is formed by sectors, each of which is bounded by arches, and the quadrangles are made in the form of rhombuses arranged in sectors with tiers with an increased number of rhombuses per one, starting from the top, wherein the cover is made of rigid identical triangular plates grouped by four for overlapping each rhombus, wherein the plates are pivotally connected to each other on adjacent sides, have two upper sides and are supported by two lower sides of the rhombus.

The disadvantage of the known domed structure is its weak stability under conditions of asymmetric loads; weak seismic and wind resistance; low thermal insulation; narrow scope of use for temporary, cold, folding buildings; complexity of manufacturing and installation; impossibility of organizing a large translucent or open aperture, including 2-floor stained glass ("second-level space"); complexity of installing the door and window apertures; high labour intensity; high material consumption; impossibility of expanding the building space by means of an additional building in the process of operation or construction without harm to the entire basic structure. These disadvantages are due to the following reasons: The bearing (force) function of a building is simultaneously performed by linear (two-dimensional) horizontal and vertical stiffeners and triangular plates—their reduction, elimination or substantial increase in size will cause instability of the entire structure; the connection of each triangular plate is carried out with hinges, that is, their mobility is preserved, which complicates weatherization of the building and installation of windows and doors; manufacturing of the building requires a large number of hinged fastenings and fastenings for creating the folding frame, wherein, proceeding from the general design of the building and geometrical proportions, the similarity of standard sizes of triangular plates of the entire surface of the building raises doubts, wherein the manufacturing of triangular shapes is complex and additionally leads to increased material consumption than the manufacturing of rectangular shapes; installation of the building requires high skills of installers and heavy special equipment for lifting and opening the folding frame from its package.

The closest analogue of the claimed invention is a dome-shaped structure disclosed in RU 2298618 C1, publ. on 10 May 2007. The dome-shaped structure comprises composite meridional arched ribs made of pivotally connected bearing elements pinned at their upper ends to the central support element, and at lower ones—to support base members uniformly located along the dome perimeter and horizontal annular bearing elements fixed to meridian arched ribs in joints of the bearing elements that form them. Wherein the structure is provided with additional stiffening elements, the annular bearing elements are made of rigid runs that form rigid trapezoidal and upper triangular sections in each of the dome sectors with the bearing elements of the meridian arched ribs, while additional stiffeners are arranged in trapezoidal sections of the dome in staggered order, and each one is made in the form of a quadrilateral of rods rigidly fixed by apexes in the middle of bearing elements which form trapezium sides.

Disadvantages of the closest analogue are high material and labour intensity, high complexity, complexity of the manufacturing and installation of the frame and facing elements, in particular the manufacturing of a large number of stiffeners of the frame and facing elements in the form of complex trapezoidal and triangular shapes of different sizes, of a large number of structure, requires high skills and leads to an increased consumption of material in production than in the case of rectangular shapes; the necessity of using a pneumatic air-supporting shell for frame installation due to insufficiently reliable fixation of building elements relative to each other during the assembly process, since the bearing (force) function is simultaneously provided by meridional arched linear (two-dimensional) ribs, linear (two-dimensional) ring elements and linear (two-dimensional) additional quadrangular stiffeners their reduction, elimination will cause instability of the whole structure; impossibility of organizing a large translucent or open aperture, including 2-floor stained glass ("second-level space") due to a large number of linear (two-dimensional) stiffeners; complexity of manufacturing and installation of window and door apertures due to standard sizes of structural elements such as triangle and trapezium; complexity of creating an interior design of a premise, complexity of selecting furniture due to the rounded shape of all exterior walls of a building; impossibility of expanding the building space by means of an additional building in the process of operation or construction without harm to the entire structure.

SUMMARY

Object of the claimed invention is to develop a multipurpose quickly erected building with simplified manufacturing and installation, increased strength characteristics, increased thermal insulation of the building, high air exchange figures, increased and evenly distributed natural daylight, achievement of high technological construction of the building by using enlarged, identical in standard size, interchangeable facing elements.

Technical result of the claimed invention is to reduce the material consumption, installation time, increase the strength and stability of the building, including under conditions of asymmetrical and dynamic loads, and to increase energy efficiency and light translucency of the building.

The said technical result is achieved due to the fact that the multipurpose dome-shaped building comprises a bearing frame having a base and an apex in the form of polygons of different perimeters, a roof at the apex of the bearing frame coated with a facing material, wherein the bearing frame is made in the form of at least three pyramidal volumetric trusses (truss structures) arranged symmetrically with respect to the base center and rigidly connected to each other in the upper part by at least one horizontal beam, wherein the volumetric trusses are arranged in such a way that the horizontal distance between closest posts of neighboring volumetric trusses remains the same over the entire height from the base and up to the top of the neighboring trusses.

Volumetric trusses are made in the shape of an inclined triangular, tetrahedral or pentahedral pyramid with straight or rounded faces and with a narrowing in the upper part.

The space between volumetric trusses is partially or completely coated with a facing material of the same size for the entire height of the trusses resulting in formation of side walls.

The side walls are opaque and/or made from a stained glass.

At least one side wall has an entrance door.

Facing material for side walls is made in the shape of a rectangle.

Volumetric trusses are sheeted with a facing material.

Facing material for volumetric trusses is made in the shape of a triangle, a trapezoid or a quadrilateral.

The roof is made flat or in the shape of a pyramid or a hemisphere.

Facing material of the roof is made in the form of sectors or one piece.

The roof frame can be made in the form of self-bearing facing elements or in the form of a frame consisting of stiffeners rigidly connected at apexes of volumetric trusses.

Facing material is flat or curved.

The bearing frame can have a sectoral cutout in the shape of a polygon half, of an elongated shape, the base of the bearing frame can be close to a rounded shape where the outer surface of volumetric trusses is aligned along the base perimeter with the facing of the building.

BRIEF DESCRIPTION OF THE DRAWINGS

The invention will be more clearly understood from the description which is not limiting and is given with references to accompanying drawings, where one of alterations of the claimed invention is shown, namely the building with a base and an apex in the shape of an octagon:

FIG. 5—examples of the building that show different sectoral cutouts.

Figure 1:
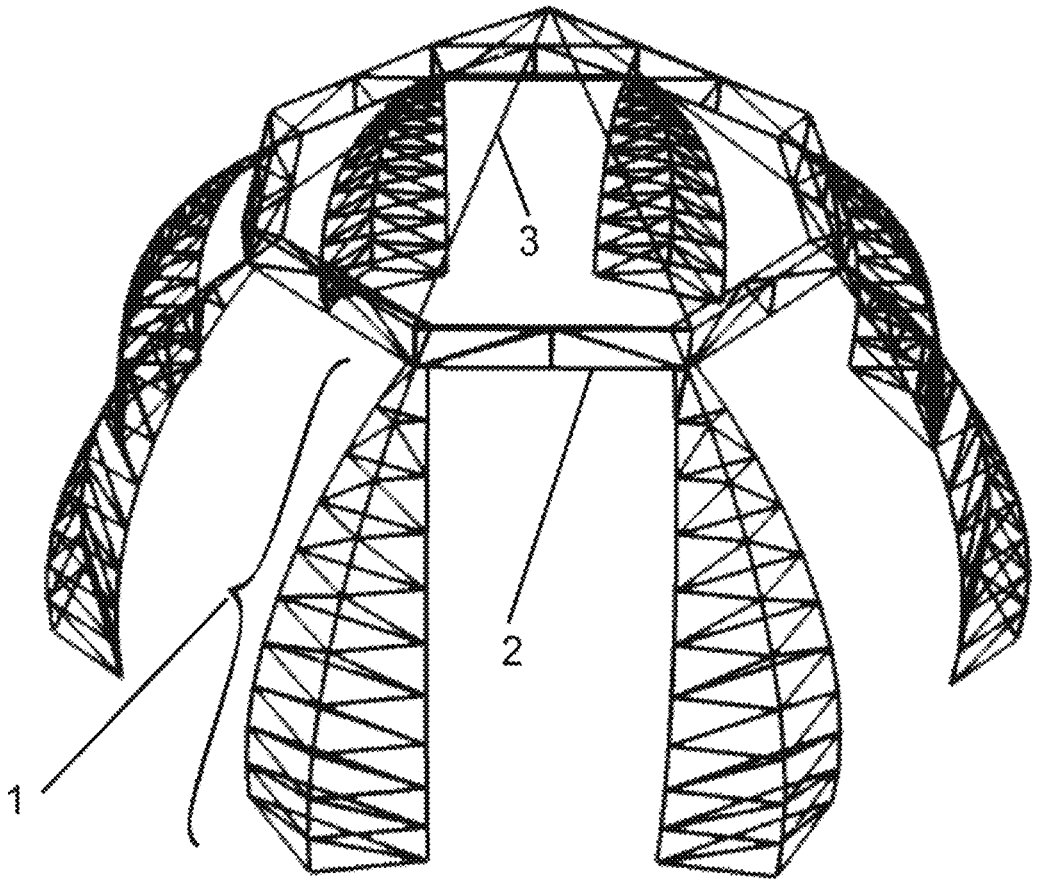
FIG. 1—the frame of the building without coating.
Figure 2:
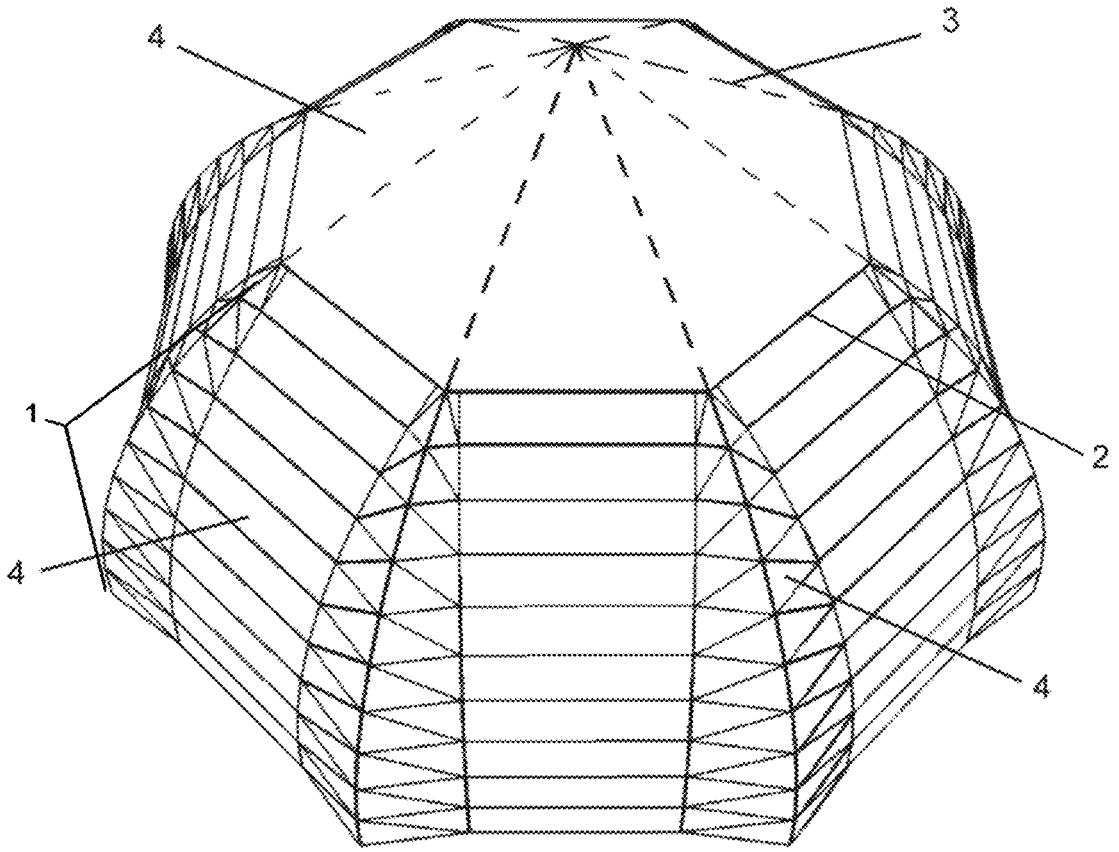
FIG. 2—a general view of the building with coating.
Figure 3:
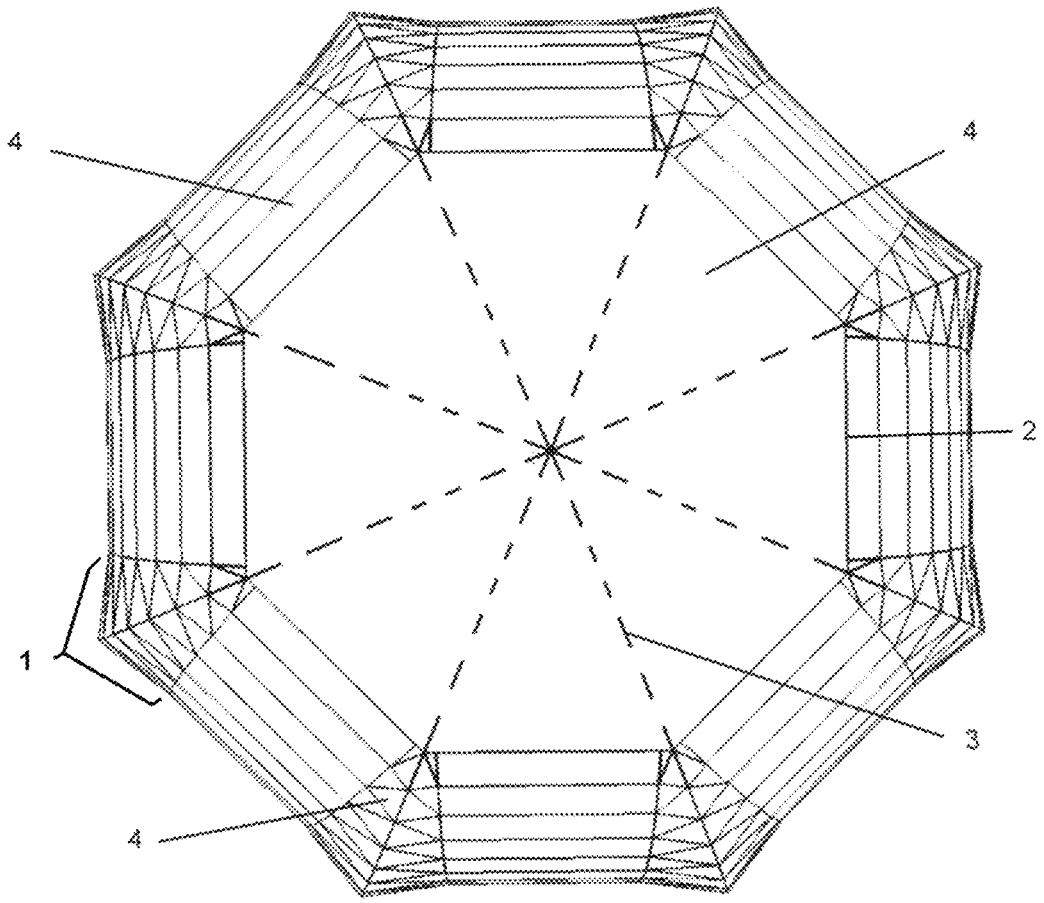
FIG. 3—a plan view of the building with coating.
Figure 4:
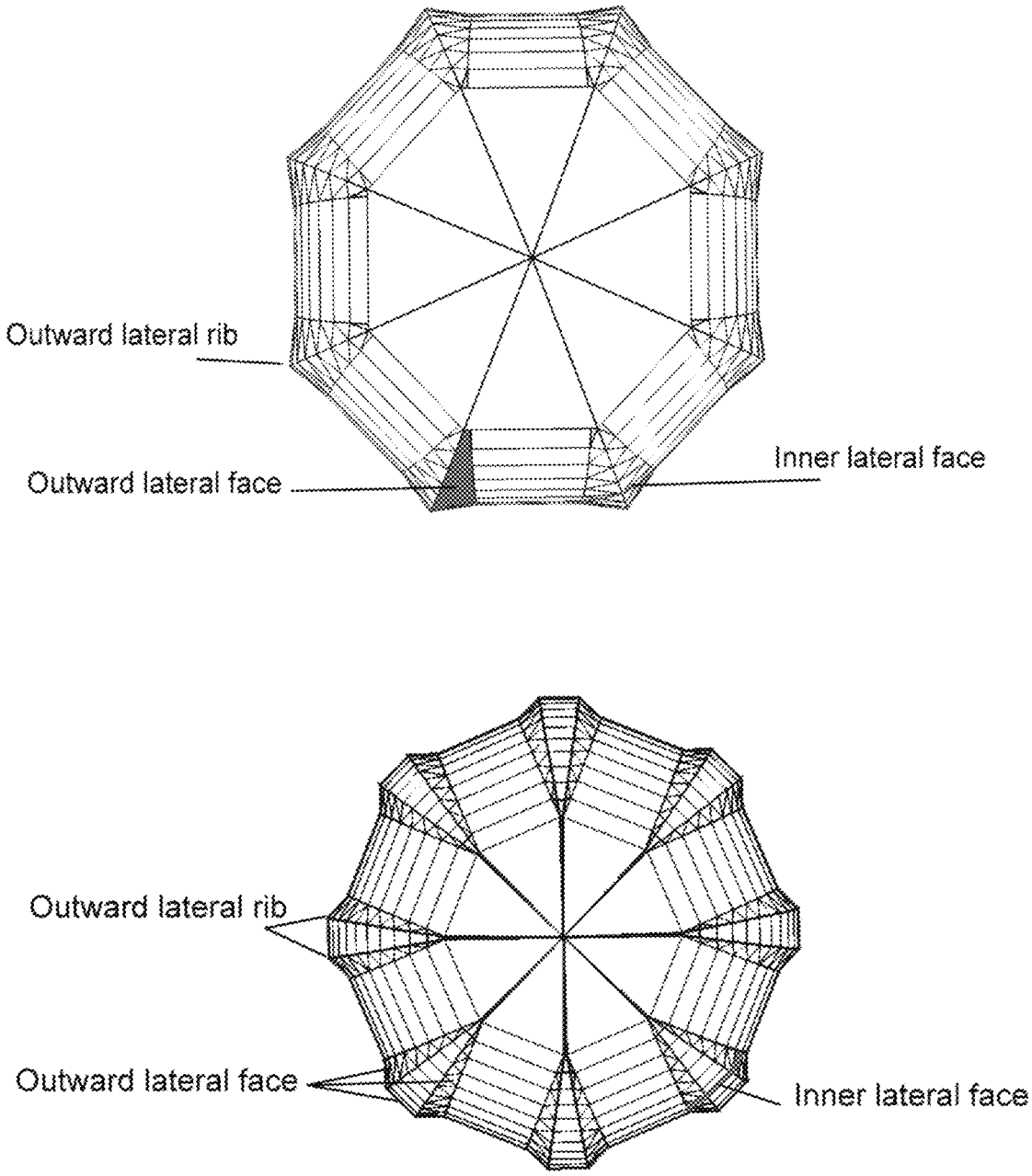
FIG. 4—examples of the building that show lateral faces and lateral rib extended outwards. and one lateral face directed inside the building.
Figure 5A:
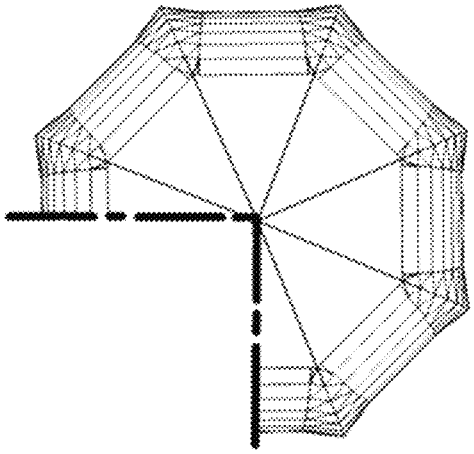
FIG. 5A—an example of the building having a bearing frame with a sectoral cutout.
Figure 5B:
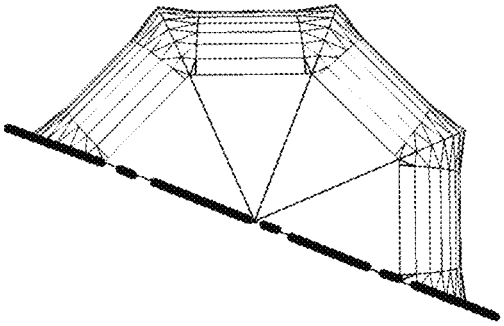
FIG. 5B—an example of the building having a bearing frame with another sectoral cutout.
Figure 6:
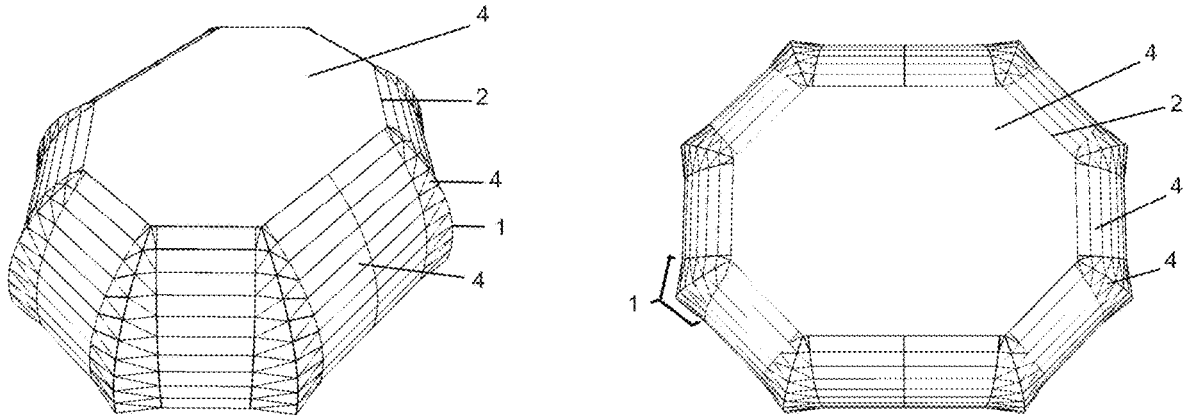
FIG. 6—an example of the building having a bearing frame that is elongated.
Figure 7:
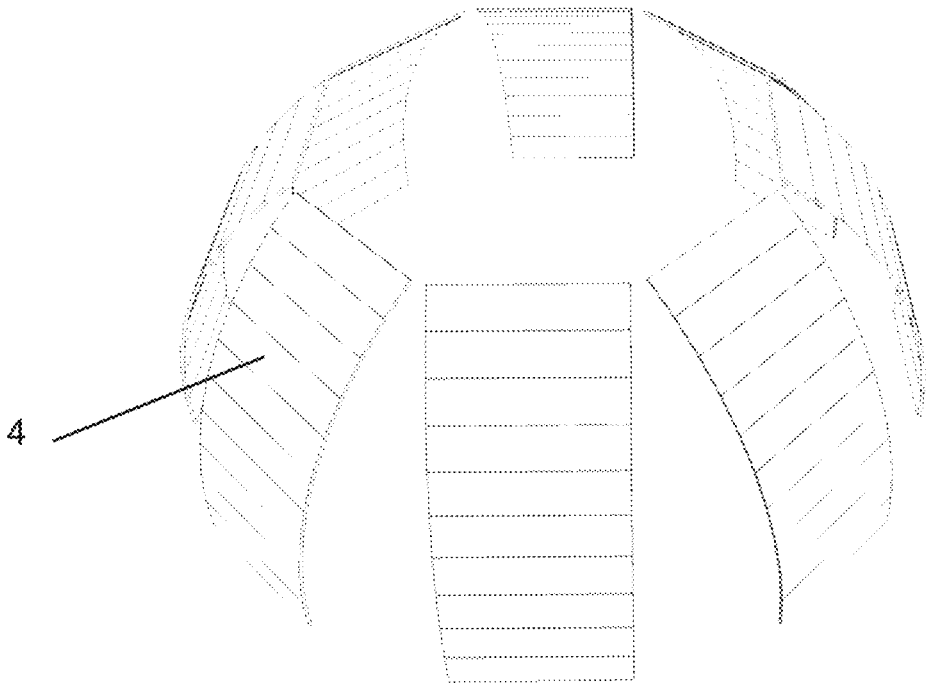
FIG. 7—rectangular facing elements (panels) of the same perimeter used for covering spaces between neighboring trusses.
Figure 8:
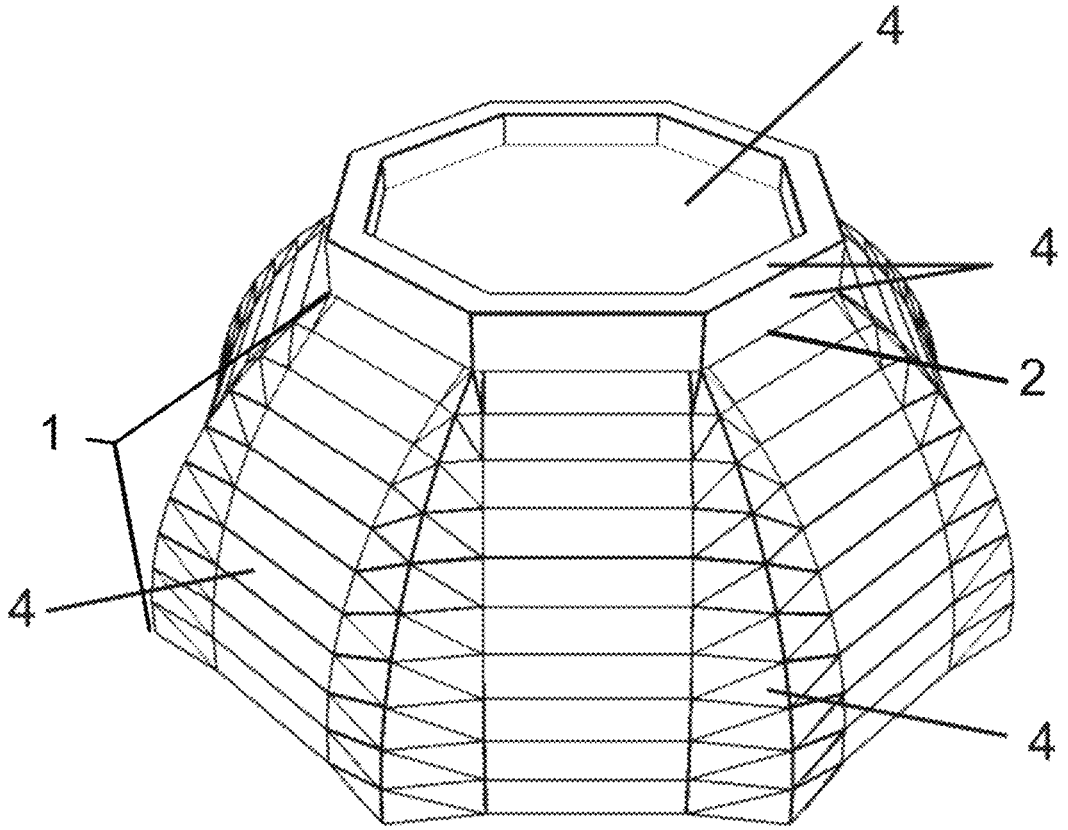
FIG. 8—an example of the building having no roof.

1—volumetric (three-dimensional) truss; 2—horizontal beam; 3—stiffeners of the roof frame; 4—facing material.

DETAILED DESCRIPTION OF THE INVENTION

The multipurpose dome-shaped building comprises a bearing frame having a base and an apex in the form of polygons of different perimeters, a roof at the apex of the bearing frame coated with a facing material (4), wherein the bearing frame is made in the form of at least three pyramidal volumetric trusses (4) arranged symmetrically with respect to the base center and rigidly connected to each other in the upper part by at least one horizontal beam (2), and wherein the volumetric trusses are arranged in such a way that the horizontal distance between closest posts of neighboring volumetric trusses (1) remains the same over the entire height from the base and up to the top of the neighbor Volumetric trusses (1) are made in the shape of an inclined triangular, tetrahedral or pentahedral pyramid with straight or rounded faces and with a narrowing in the upper part.

The space between volumetric trusses (1) is partially or completely coated with a facing material of the same size for the entire height of the trusses resulting in formation of side walls.

The side walls are opaque and/or made of a stained glass.

At least one side wall has an entrance door or a window aperture.

The facing material (4) for coating the space between volumetric trusses (1) is made in the shape of a rectangle.

Volumetric trusses are coated with a facing material (4).

The facing material (4) for coating the volumetric trusses is made in the shape of a triangle, a trapezoid or a quadrilateral.

The roof is made flat or in the shape of a pyramid or a hemisphere.

The facing material (4) for coating the roof is made in the form of sectors or one piece.

The roof frame can be made in the form of self-bearing facing elements or in the form of a frame consisting of stiffeners (3) rigidly connected at apexes of volumetric trusses.

The facing material (4) is flat or curved.

The bearing frame is made with a sectoral cutout, which allows attaching an additional building to the corner of the existing building, including the one with rectilinear walls.

The bearing frame is made in the shape of a polygon half, which allows attaching an additional building to the wall of the existing building, including the one with rectilinear walls.

The bearing frame is elongated.

The base of the bearing frame is close to rounded shape, and the outer surface of volumetric trusses (1) is aligned with coating of the building along the base perimeter.

Multipurpose dome-shaped building is assembled as follows. From 3 to 12 pyramidal volumetric trusses (1) are installed symmetrically with respect to each other on a prepared smooth surface, wherein they are rigidly connected in the upper part by a horizontal beam (2) to form a bearing frame having a base and an apex in the shape of polygons of different perimeters (triangle, quadrilateral, etc.), and a roof is installed at the top of the bearing frame, formed by stiffeners rigidly connected at apexes of volumetric trusses. Wherein a space equidistant over the entire height from the base to the top of trusses is formed between outermost posts of the volumetric truss (1). After that, the roof, the space between volumetric trusses (1) and volumetric trusses (1)

themselves are sheeted with facing material. The base of each truss is a polygon in frontal section, preferably a triangle, a quadrangle or a pentagon, wherein the truss tapers in its upper part. Volumetric trusses (1) can be rigidly connected to each other by means of rectangular flat trusses (see FIG. 1) comprising two horizontal beams coupled to each other by means of posts and diagonal rods. The distance at which volumetric trusses are located from the base (1) center is not limited in size, preferably is 1.5-25 m.

A facing material for the roof, for the space between volumetric trusses (1) and for volumetric trusses (1) themselves can be chosen among any non-transparent and translucent roofing and walling facing materials suitable for covering external surfaces of a building, including double-glazed windows, one-piece glass, sandwich-panels, structural insulating panels, ETFE films, PVC films and awnings, fibrolite slabs, aluminium composite sheets, copper sheets, sheets of stainless, galvanized steel, light steel thin-walled structures, OSB plates, cellular polycarbonate, sheet acryl and etc.

Additional horizontal and diagonal connections between outermost posts of volumetric trusses can be installed to increase the strength and rigidity of the bearing frame in case of increased asymmetrical and dynamic loads.

The designing and placement of trusses are carried out in such a way that the horizontal distance between outermost posts of a truss at the entire height from the base to the top (building aperture) is made equal for using rectangular elements of the same standard size as a covering.

The bearing frame can be made close to rounded shape, in which case the outer surface of volumetric trusses (1) is coated with facing material along the perimeter of the bearing frame, wherein angular parts of volumetric trusses (1) are directed inwards.

The bearing frame consists of at least three inclined volumetric (three-dimensional) pyramidal trusses with a base in the shape of a polygon and a tapered upper part, such that the horizontal distance between outermost posts of the truss is made equal from the base to the top (the aperture of the building).

The truss can consist of segments connected by means of fasteners or welding. The trusses are manufactured in factory conditions and are easily transported by any freight transport. Assembly is carried out on a construction site by any conventional methods without using heavy special equipment.

Any material used for bearing frames of buildings, preferably made of aluminium, steel, stainless steel, composite materials, can be used to make volumetric trusses.

The outer covering of volumetric trusses, apertures and the roof of a building is carried out by any conventional methods of manufacturing and assembly from any non-transparent and translucent roofing and walling facing materials suitable for coating the external surfaces of buildings, including double-glazed windows, one-piece glass, sandwich-panels, structural insulating panels, ETFE films, PVC films and awnings, fibrolite slabs, aluminium composite sheets, copper sheets, sheets of stainless, galvanized steel, light steel thin-walled structures, OSB plates, cellular polycarbonate, sheet acryl and etc., which increases the translucency and energy efficiency of the building.

The space of each individual truss can be used as an auxiliary premise.

The space of the roof made in the form of pyramid or dome can be used as an auxiliary premise, a winter garden, a home greenhouse.

The claimed building design simplifies the manufacturing and installation of a building, reduces the installation time, increases the strength by using volumetric trusses in the bearing frame and connecting them in the upper part in such a way that the horizontal distance between outermost posts of a truss at the entire height from the base to the top (the building aperture) is made equal for using rectangular elements of the same standard size as a covering.

Wherein free apertures between trusses occupy a larger surface area of the building, are not bearing, which significantly reduces the amount of material required to create a frame and the overall rigidity of the building structure.

The uniformity of standard sizes of apertures allows them to be interchangeable, including for the purpose of transformation in the process of operation or construction into a required equipment, depending on the change in functional purpose or appearance of a building; it also makes it possible to easily attach an additional building, transfer door and window apertures—without harm to and change of the bearing frame, allows organizing a fairly rectilinear inner surface of the building, which simplifies the installation, selection and layout of standard rectilinear furniture.

The claimed invention allows designing volumetric-spatial compositions consisting of a connection of several buildings of this type and their sectors in width and height.

The claimed invention allows forming a spherical building by connecting bases of mirror-placed dome-shaped buildings, wherein the upper and lower buildings are different in height of the frame and the facing materials used.

Thus, the proposed invention allows obtaining a new shape of a building that has an increased transformation, functionality, progressiveness, aesthetics of the spatial shape with large translucent apertures, wherein it ensures a reduction in material consumption and laboriousness, simplification of manufacturing and installation, reduction of installation time, no need for heavy special equipment and highly qualified personnel, manufacturing of building elements at production facilities, independence of the bearing frame and covering elements, increased stability, strength, including under asymmetrical, dynamic loads, increased energy efficiency of a building, maximum use of natural daylight, ease of attaching an additional building, uniformity of standard sizes of aperture covering elements and their interchangeability in operation or construction without harm to and changes in the building frame, simplification of the installation of door apertures and self-organization of window apertures, self-organization of additional interior spaces in addition to total useful area, organization of sufficiently flat interior walls.

The invention was disclosed above with reference to a specific embodiment thereof. Other embodiments of the invention that do not change its nature, as disclosed herein, may be apparent to those skilled in the art. Accordingly, the invention should be considered limited in scope only by the following claims.

The invention claimed is:

1. A multipurpose dome-shaped building comprising:

a bearing frame having at least three inclined arcuate pyramidal volumetric trusses, wherein each truss has a base with a polygonal form, tapers in an upper part, and has at least two lateral faces and at least one lateral rib extended outwards, and has at least one lateral face directed inside the building, wherein all said trusses are arranged symmetrically with respect to a vertical axis of symmetry, rigidly attached to each other in upper parts of said trusses by at least one horizontal beam, and arranged in such a way that a horizontal distance between closest posts of neighboring trusses remains the same over an entire height of each truss, and wherein the upper parts of the trusses and the at least one horizontal beam form a horizontal plane having a polygonal form;

panels coated with a facing material covering spaces between neighboring trusses or spaces within trusses.

2. The building according to claim 1, wherein the trusses are made as an inclined arcuate triangular, tetrahedral or pentahedral pyramid.

3. The building according to claim 1, wherein a roof is arranged on the horizontal plane of the bearing frame.

4. The building according to claim 1, wherein the roof is made flat or in a shape of a pyramid or a hemisphere.

5. The building according to claim 3, wherein the panels covering the roof are made in a form of sectors or as a one piece.

6. The building according to claim 3, wherein the roof is made in a form of self-bearing facing elements or as a frame consisting of stiffeners (3) rigidly connected to the horizontal beam.

7. The building according to claim 1, wherein side walls and windows are formed in spaces between neighboring trusses covered with panels.

8. The building according to claim 7, wherein at least one side wall has an entrance door.

9. The building according to claim 1, wherein the trusses are covered with panels.

10. The building according to claim 9, wherein the panels are of a triangle, a trapezoid or a quadrilateral shape.

11. The building according to claim 1, wherein the panels covering spaces between neighboring trusses are of a rectangular shape and have the same perimeter.

12. The building according to claim 1, wherein the panels are made flat or curved.

13. The building according to claim 1, wherein the bearing frame is made with a sectoral cutout.

14. The building according to claim 1, wherein the bearing frame is made in a shape of a polygon half.

15. The building according to claim 1, wherein the bearing frame is elongated.

* * * * *